US006909868B2

(12) United States Patent
Yamada et al.

(10) Patent No.: US 6,909,868 B2
(45) Date of Patent: Jun. 21, 2005

(54) BRUSH CHARGER FOR STATIC-CHARGING A PHOTOSENSITIVE MEMBER AND IMAGE FORMING APPARATUS

(75) Inventors: Chiaki Yamada, Takatsuki (JP); Keiko Momotani, Ibaraki (JP)

(73) Assignee: Minolta Co., Ltd., Osaka (JP)

( * ) Notice: Subject to any disclaimer, the term of this patent is extended or adjusted under 35 U.S.C. 154(b) by 23 days.

(21) Appl. No.: 10/413,206

(22) Filed: Jun. 18, 2003

(65) Prior Publication Data

US 2004/0136752 A1 Jul. 15, 2004

(30) Foreign Application Priority Data

Jan. 15, 2003 (JP) ..... 2003-007565

(51) Int. Cl.[7] ..... G03G 15/02
(52) U.S. Cl. ..... 399/175; 361/221
(58) Field of Search ..... 399/174, 175; 361/221, 225, 212, 220

(56) References Cited

U.S. PATENT DOCUMENTS

| | | | | |
|---|---|---|---|---|
| 5,479,244 | A | | 12/1995 | Kashihara et al. |
| 5,508,788 | A | | 4/1996 | Watanabe et al. |
| 5,835,821 | A | * | 11/1998 | Suzuki et al. ..... 399/174 |
| 2003/0123909 | A1 | * | 7/2003 | Akashi et al. |
| 2003/0162111 | A1 | * | 8/2003 | Otani et al. |

FOREIGN PATENT DOCUMENTS

| | | |
|---|---|---|
| JP | 2001-242688 | 9/2001 |

* cited by examiner

*Primary Examiner*—Susan Lee
(74) *Attorney, Agent, or Firm*—Morrison & Foerster LLP

(57) ABSTRACT

A brush charger for static-charging a photosensitive drum by a contact method has a charging brush roller. The charging brush roller has a brush of a large number of conductive fibers, and the brush is wound around a conductive support spirally. The conductive fibers are 1.5 to 4 deniers in thickness D, are 2 mm in length L and are planted at a density not less than 150,000 filaments/inch$^2$, and the thickness D and the length L of the conductive fibers meet the condition, $D \geqq 0.71L-1.61$.

22 Claims, 7 Drawing Sheets

BRUSH CHARGER FOR STATIC-CHARGING A PHOTOSENSITIVE MEMBER AND IMAGE FORMING APPARATUS

This application is based on Japanese patent application No. 2003-7565, the contents of which is hereby incorporated by reference.

BACKGROUND OF THE INVENTION

1. Field of the Invention

The present invention relates to a brush charger and an image forming apparatus, and more particularly to a brush charger for static-charging the surface of a photosensitive member evenly to a specified potential before forming an image on the photosensitive member by an electrophotographic method, and an image forming apparatus provided with the brush charger.

2. Description of Related Art

While electrophotographic full-color image forming apparatuses have been propagated, demand for higher picture quality has been increased. In order to form an image of high quality, it is especially important to static-charge a photosensitive member evenly. Conventionally, a corona discharger is generally used for the purpose. However, a corona discharger charges a photosensitive member by a non-contact method, and therefore, it generates ozone which is harmful to human beings. In order to reduce the amount of ozone which is generated at the time of charging a photosensitive member, a brush charger which charges a photosensitive member by rubbing the photosensitive member with a brush of conductive fibers has been suggested. The following prior arts disclose such brush chargers.

Reference 1 (U.S. Pat. No. 5,479,244) discloses a brush charger which has a brush of synthetic resin semiconductive fibers and teaches that the brush has the following specifications: the fibers are 1.5 to 15 deniers in thickness; the fibers are 2 to 10 mm in length; and the fibers are planted at a density within a range from 50,000 to 500,000 filaments/inch$^2$. However, the fibers are planted on a plane, and the brush charger is a fixed type. The reference 1 does not teach that a roller type brush is rotated.

Reference 2 (U.S. Pat. No. 5,508,788) discloses a fixed type brush of conductive fibers that the fibers are planted at a density within a range from 10,000 to 400,000 filaments/inch$^2$. The reference 2 also discloses a rotary type brush of conductive fibers that the fibers are planted at a density of 100,000 filaments/inch$^2$.

Reference 3 (Japanese Patent Laid-Open Publication No. 2001-242688) discloses an image forming apparatus which adopts a brush charging method in which a superimposed voltage of a DC voltage and an AC voltage is applied for charging of a photosensitive member and adopts a non-contact developing method in which an AC voltage is applied for development of an electrostatic latent image. However, there are no detailed descriptions about the brush.

According to the brush charging method disclosed by the prior arts above, charging of a photosensitive member is carried out by discharge from each of the conductive fibers, and it is difficult to charge the photosensitive member evenly. Consequently, in an image forming apparatus provided with such a conventional brush charger, it has been impossible to obtain full-color images of satisfying quality.

SUMMARY OF THE INVENTION

An object of the present invention is to provide a brush charger which charges a surface of a photosensitive member to a specified potential evenly, permitting formation of an image of high quality.

Another object of the present invention is to provide an image forming apparatus in which a surface of a photosensitive member is charged to a specified potential evenly, thereby resulting in formation of an image of high quality.

In order to attain the objects above, a first aspect of the present invention provides a brush charger which comprises: a charging brush roller for charging an object, and a conductive support which supports the charging brush roller. The roller has a brush with a large number of conductive fibers. The conductive fibers of the charging brush roller have a thickness D within a range from 1.5 deniers to 4 deniers, have a length L not less than 2 mm and are planted at a density not less than 150,000 filaments/inch$^2$, and the thickness D and the length L of the conductive fibers meet the condition, $D \geqq 0.71L-1.61$.

The brush charger according to the first aspect of the present invention has a rotary brush roller, and for the brush roller, relatively thin conductive fibers are planted at a high density. Also, the thickness D and the length L of the conductive fibers meet the above condition. Thereby, the brush charger can charge the surface of the object to a specified potential evenly, which results in formation of an image of high quality.

It is difficult to produce conductive fibers with a thickness less than 1.5 deniers. If conductive fibers with a thickness more than 4 deniers are used for the brush roller, the object charged by the brush roller will partly have a higher potential, resulting in white strips in a halftone image.

If the conductive fibers of the brush roller are planted at a density less than 150,000 filaments/inch$^2$, the brush roller cannot perform even charging, and it is impossible to form an image of high quality. It is desired that the conductive fibers are planted at a density not less than 250,000 filaments/inch$^2$, and the conductive fibers should be planted as dense as possible.

The brush roller is rotated in a direction opposite to a moving direction of the object at a speed which is one or more times, and preferably 1.5 to 3 times the moving speed of the object.

A second aspect of the present invention provides an image forming apparatus which comprises: an electrostatic latent image bearing member; a brush charger according to the first aspect of the present invention; an electrostatic latent image forming device for forming an electrostatic latent image on the image bearing member after charging of the image bearing member by the brush charger; and a developing device for developing the electrostatic latent image.

Further, a third aspect of the present invention provides an image forming apparatus which comprises: an electrostatic latent image bearing member; a brush charger for charging the image bearing member; an electrostatic latent image forming device for forming an electrostatic latent image on the image bearing member after charging of the image bearing member by the brush charger; and a developing device for developing the electrostatic latent image by a non-contact developing method. In the apparatus, the brush charger has a brush with a large number of conductive fibers and is supplied with a DC voltage, and the conductive fibers have a thickness within 1.5 deniers to 4 deniers and are planted at a density not less than 150,000 filaments/inch$^2$. The developing device comprises a developer bearing member, and when a developing bias voltage which is a superimposed voltage of a DC voltage and an AC voltage is applied to the developer bearing member, toner flows from the developer bearing member to the image bearing member to develop the electrostatic latent image.

In the image forming apparatus according to the third aspect of the present invention, the brush charger has a rotary brush roller, and for the brush roller, thin conductive fibers are planted at a high density. Therefore, the brush charger can charge the surface of the image bearing member to a specified potential evenly, and it is possible to combine the brush roller with a developing device which carries out non-contact development which is excellent in reproducibility and vividness of fine images. Consequently, it is possible to form images of high quality.

BRIEF DESCRIPTION OF DRAWINGS

These and other objects and features of the present invention will be apparent from the following description with reference to the accompanying drawings, in which.

DETAILED DESCRIPTION OF PREFERRED EMBODIMENTS

Figure 1:
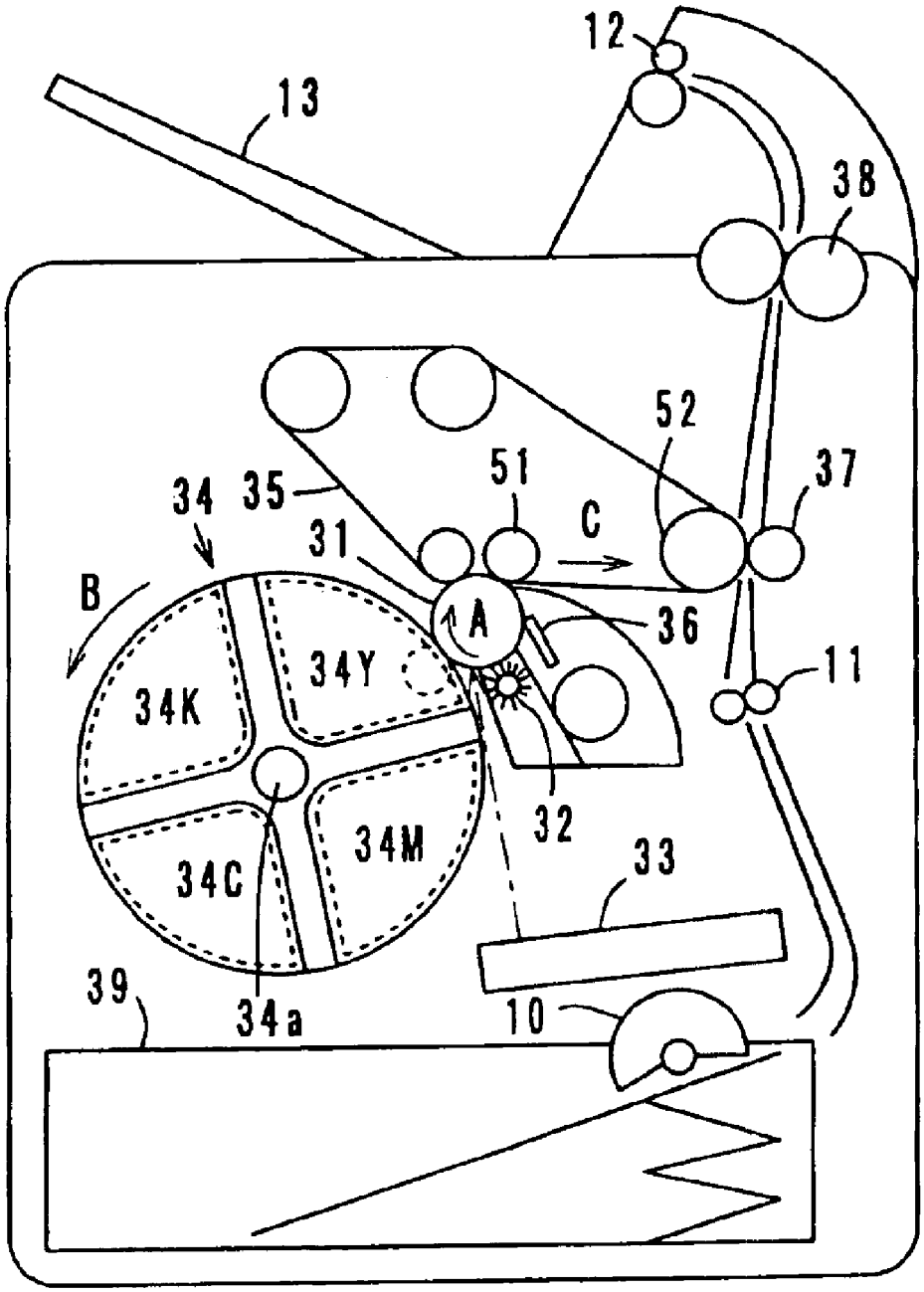
FIG. 1 is a schematic view of a full-color laser printer according to a preferred embodiment of the present invention.

Brush chargers and image forming apparatuses according to preferred embodiments of the present invention will be described with reference to the accompanying drawings.

Image Forming Apparatus; See FIG. 1

First, referring to FIG. 1, an image forming apparatus according to a preferred embodiment of the present invention is described in connection with its structure and its operation. This image forming apparatus is a full-color laser printer, and comprises a conventional photosensitive drum 31, a laser scanning optical device 33, a full-color developing unit 34, an intermediate transfer belt 35, a fixing device 38, a feed cassette 39, a paper ejection tray 13 and other devices. Around the photosensitive drum 31, there are arranged a brush charger 32, the full-color developing unit 34, first transfer rollers 51 and a toner cleaning device 36.

The laser scanning optical device 33 is of a conventional type which incorporates a laser diode serving as a light source, a polygon mirror serving as a deflector, an fθ optical elements, etc. To a control section of the laser scanning optical device 33, print data for C (cyan), M (magenta), Y (yellow) and K (black) are sent from a host computer. In accordance with the print data for the respective colors, the laser scanning optical device 33 modulates a laser beam and scans the photosensitive drum 31.

While the photosensitive drum 31 is rotated in a direction shown by arrow "A", the photosensitive drum 31 is charged with a specified surface potential by the brush charger 32 as will be described later, and an electrostatic latent image is formed by being exposed to the laser beam.

The full-color developing unit 34 is an integrated unit of developing devices 34C, 34M, 34Y and 34K which contain toners of the respective colors C, M, Y and K. The full-color developing unit 34 is rotated in a direction shown by arrow "B" on a shaft 34*a*. Every time an electrostatic latent image of a color is formed on the photosensitive drum 31, the developing unit 34 is rotated so that the developing device which contains toner of the color will come to a developing area. Then, the electrostatic latent image is developed into the color.

Each of the developing devices is, for example, of a non-contact developing type which uses one-component non-magnetic toner, and the developing devices carry out negative development. Therefore, the toner in each of the developing devices is charged with the same polarity as the photosensitive drum 31, and the toner sticks to image portions of which potential has been lowered by the exposure. The structure and the developing operation of the developing devices will be described in detail later.

The intermediate transfer belt 35 is an endless belt which is bridged among rollers including the rotary first transfer rollers 51 and a supporting roller 52. The intermediate transfer belt 35 is rotated in a direction shown by arrow "C". In the meantime, by applying a first transfer voltage to the first transfer roller 51, a toner image formed on the photosensitive drum 31 is transferred onto the intermediate transfer belt 35 (first transfer). By repeating the first transfer, toner images of the respective colors are superimposed, and thereby, a full-color image is formed.

Also, a second transfer roller 37 leans against the supporting roller 52 with the transfer belt 35 in-between, and the second transfer roller 37 freely rotates. By applying a second transfer voltage to the second transfer roller 37 while a paper is traveling between the intermediate transfer belt 35 and the second transfer roller 37, the full-color toner image is transferred onto the paper.

Papers are fed out of the feed cassette 39 one by one by a feed roller 10, and the fed-out paper is transported to the second transfer position by a timing roller pair 11 in synchronization with the toner image on the intermediate transfer belt 35.

The toner image second transferred onto the paper is heated and fixed thereon by the fixing device 38, and the paper is ejected onto the tray 13 by an ejection roller pair 12.

There are various types of full-color image forming apparatuses, and the laser printer shown by FIG. 1 is a four-cycle type which has four developing devices around one photosensitive drum 31. However, the present invention is applicable not only to the four-cycle type but also to other types, for example, a tandem type which has four photosensitive drums arranged in parallel along an intermediate transfer belt.

Also, the present invention is applicable to monochromatic image forming apparatuses as well as full-color laser printers. Further, the present invention is applicable not only to development which uses a one-component developer containing only toner but also to development which uses a two-component developer composed of toner and carriers.

Brush Charger; See FIGS. 2 Through 5

Figure 3:
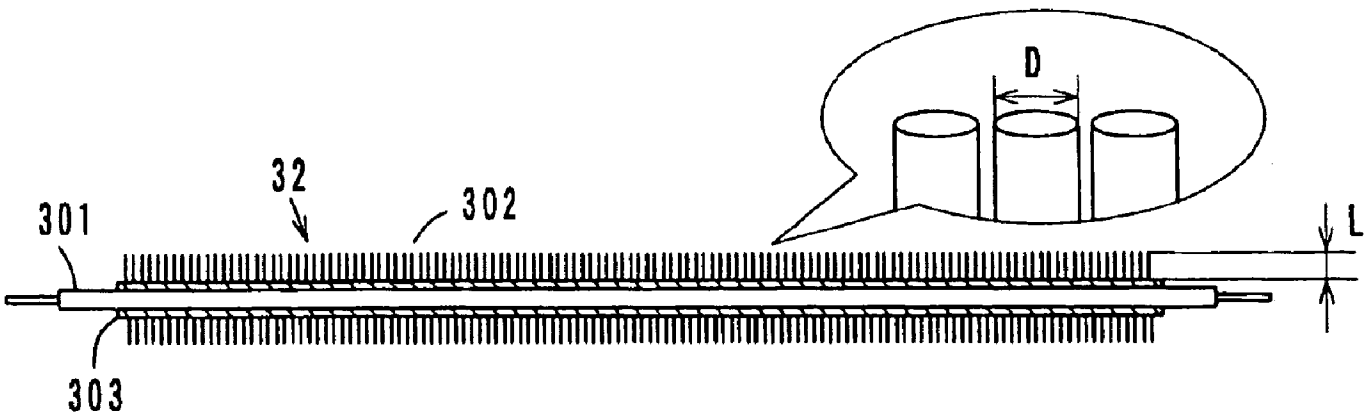
FIG. 3 is an axial sectional view of the brush charger.
Figure 4:
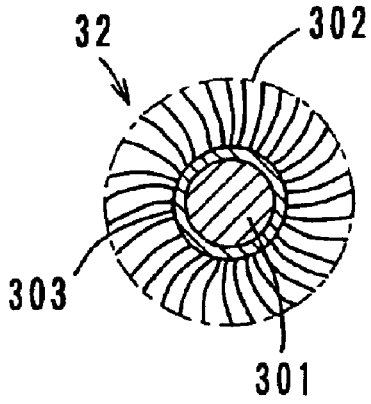
FIG. 4 is a cross sectional view of the brush charger.

The brush charger 32 charges the surface of the photosensitive drum 31 to a specified potential when a voltage is applied to the brush charger 32 while being in contact with the photosensitive drum 31. As FIG. 2 through 4 show, the brush charger 32 is a roller which has a charging brush 302 around a conductive support 301, and the charging brush 302 has a large number of conductive fibers planted on a cloth 303.

The conductive support 301 is a metal, such as stainless, aluminum, etc., or other conductive material.

The conductive fibers are fibers of a mixture of synthetic resin and a conductive material. As the synthetic resin, polyamide such as nylon, rayon, polyester, polyolephin, polycarbonate, polyurethane and acryl can be used, and it is preferred to use nylon as the main component. As the conductive material, conductive carbon, metal powder, zinc oxide, titanium oxide, tin oxide and other suitable materials which can mix with the synthetic resin evenly can be used.

Figure 2:
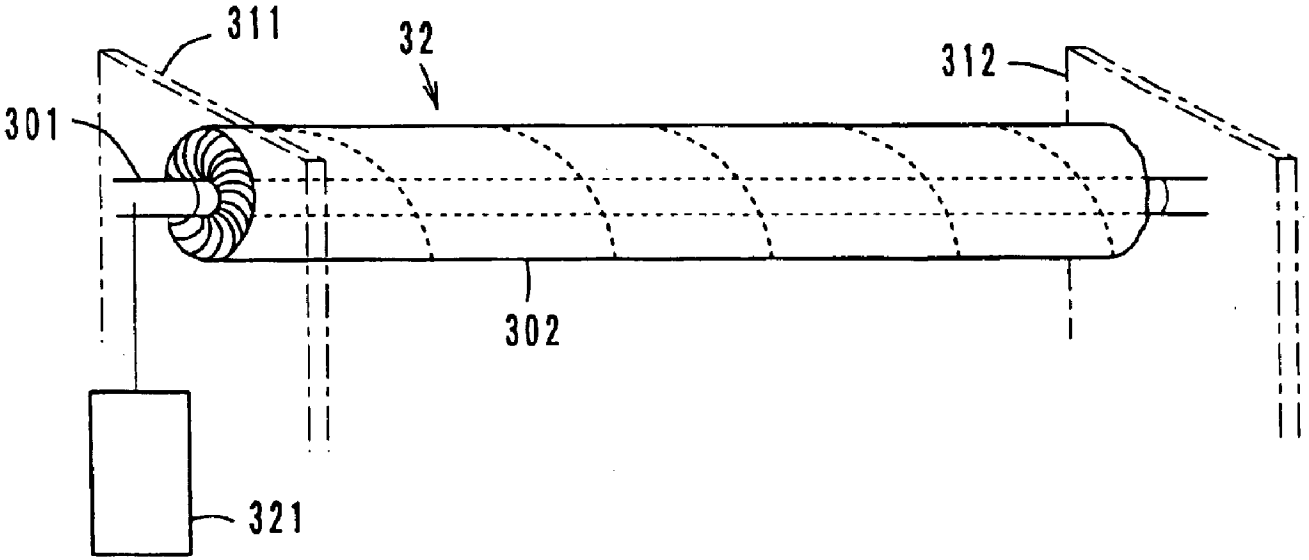
FIG. 2 is a perspective view of a brush charger according to a preferred embodiment of the present invention.

It is easy to spirally wind the charging brush 302 with conductive fibers planted on the cloth 302 around the conductive support 301 (see FIG. 2). As long as the charging brush 302 can be wound around the support 301 without any gaps, any other winding methods can be adopted.

If there are gaps among winds of the charging brush 302, the density of fibers at the wind portions is low, and charging failure may be caused.

FIG. 3 is an axial sectional view of the brush charger 32. The conductive fibers are 1.5 to 4 deniers, and preferably are within a range from 1.5 to 2.5 deniers. According to the results of experiments conducted by the present inventors, when the conductive fibers were more than 4 deniers, the surface potential of the photosensitive drum 31 was partly higher, which caused white lines in a halftone image. Also, it was difficult to make conductive fibers less than 1.5 deniers, and it was impossible to produce a brush charger by using conductive fibers less than 1.5 deniers.

The density of the conductive fibers is not less than 150,000 filaments/inch$^2$, and desirably not less than 250,000/inch$^2$. When the density was less than 150,000 filaments/inch$^2$, the charging was uneven, and the image obtained thereafter was of poor quality. Further, by designing the density of the conductive fibers to be not more than 500,000 filaments/inch$^2$, a brush charger can be produced at low cost.

On the other hand, using thin conductive fibers may cause the following problem: when the photosensitive drum 31 and the charging brush 302 are rotated while being in contact with each other, creep of the conductive fibers of the charging brush 302 occurs, and accordingly, the diameter of the charging brush 302 becomes smaller, thereby causing charging failure.

The present inventors found out from experiments that creep of the conductive fibers which occurs during rotation of the charging brush 302 is in relation to the length and the thickness of the conductive fibers. When the conductive fibers were more than a specified length while having a specified thickness, heavy creep of the conductive fibers occurred, and it was impossible to charge a photosensitive drum 31 evenly. When the thickness D and the length L of the conductive fibers met the following condition (1), even charging of the photosensitive drum 31 resulting in formation of an image of high quality was possible.

$$D \geqq 0.71L - 1.61 \quad (1)$$

The length L of the conductive fibers was calculated from the shirring diameter of the charging brush 302 (the diameter of the brush 302 after a cutting treatment) and the thickness of the cloth 303. More specifically, the length L of the conductive fibers was calculated by (shirring diameter−outer diameter of the support−the thickness of the cloth×2)/2. If the charging brush 302 was subjected to a curling treatment, the length of the conductive fibers in the upright posture before the curling treatment was taken as the length L.

With respect to the length L of the conductive fibers, when the length L was less than 2 mm, remarkable uneven charging occurred at the wind portions of the charging brush 302 around the conductive support 301.

Figure 5:
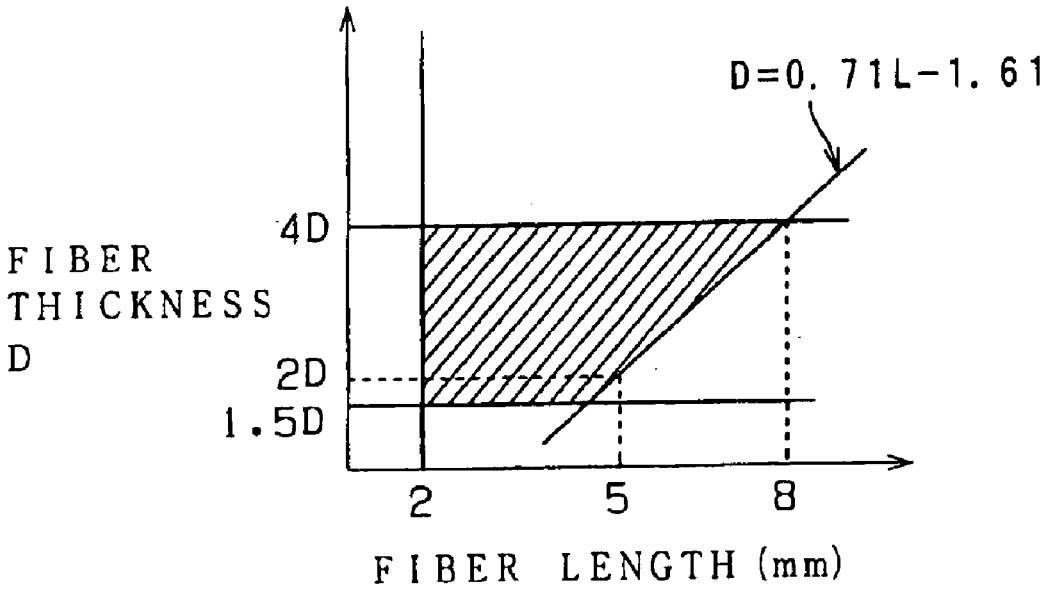
FIG. 5 is a graph which shows the relationship between the thickness and the length of fibers of the brush charger.

In consideration for the points above, the thickness and the length of the conductive fibers of the charging brush 302 are suited to be within a range shown by the hatched portion in FIG. 5.

FIG. 4 is a cross sectional view of the brush charger 32. After winding the charging brush 302 around the support 301, the conductive fibers are cut so as to have a uniform length. It is sufficient to leave the fibers in the upright posture. However, by carrying out a curling treatment to curl the tips of the conductive fibers in one direction, the charging performance of the brush charger 32 becomes better. The curling treatment may be carried out by heat or by electric power, and other suitable methods can be adopted for the curling treatment.

The brush charger 32, as shown by FIG. 2, is rotatably fitted to frames 311 and 312. The charging brush 302 may be rotated in the same direction (with direction) as or in the opposite direction (counter direction) to the rotating direction of the photosensitive drum 31. There may be a difference between the circumferential speed of the charging brush 302 and the circumferential speed of the photosensitive drum 31. When the circumferential speed of the charging brush 302 is one or more times the circumferential speed of the photosensitive drum 31, the evenness of charging carried out by the brush charger 32 is improved. In the experiments conducted by the present inventors, desirable results were obtained when the charging brush 302 was rotated in the counter direction at a circumferential speed which is 1.5 to 3 times the circumferential speed of the photosensitive drum 31.

By applying a DC voltage from a DC source 321 (see FIG. 2) to the charging brush 302 through the support 301, the brush charger 32 charges the surface of the photosensitive drum 31 to a specified potential. Although the voltage to be applied to the charging brush 302 depends on the type of the photosensitive member, the voltage is generally within a range from −1,600V to −800V. There may be a case where a voltage out of the range is applied to the charging brush 302.

An AC voltage may be superimposed to the charging brush 302 with the DC voltage. However, when an AC voltage is applied, refuse on the photosensitive drum 31 which remains after cleaning is apt to stick to the charging brush 302. In order to avoid this trouble, applying only a DC voltage is preferable.

Specific Example of Brush Charger

Now referring to Table 1, charging brush 1 through 13 which were used in the experiments which will be described below are described.

Charging Brush 1

The charging brush 1 had conductive fibers of nylon with conductive carbon dispersed therein. The conductive fibers were 2 deniers in thickness and were planted at a density of 300,000 filaments/inch$^2$. The charging brush was wound around a stainless shaft with an outer diameter of 6 mm spirally, and thereafter, the conductive fibers were cut so that the surface of the brush would be uniform. The length of the conductive fibers after the cutting treatment was 3.8 mm. Further, the tips of the conductive fibers were curled by heat so that the outer diameter of the brush would be 12.5 mm.

Charging Brushes 2 Through 13

The charging brushes 2 through 13 had conductive fibers which had thicknesses, lengths and planting densities shown by Table 1, respectively. These charging brushes 2 through 13 were produced by the same processes described above.

TABLE 1

| | Conditions of Brush | | |
|---|---|---|---|
| | Fiber Thickness (denier) | Planting Density (F/inch$^2$) | Fiber Length (mm) |
| Brush 1 | 2.1 D | 300,000 | 3.8 |
| Brush 2 | 2.1 D | 260,000 | 3.8 |
| Brush 3 | 2.1 D | 480,000 | 3.8 |
| Brush 4 | 2.1 D | 300,000 | 4.8 |
| Brush 5 | 2.1 D | 300,000 | 2.3 |
| Brush 6 | 1.5 D | 480,000 | 3.5 |
| Brush 7 | 4 D | 240,000 | 4.8 |
| Brush 8 | 6 D | 150,000 | 3.5 |
| Brush 9 | 2.1 D | 100,000 | 3.5 |
| Brush 10 | 2.1 D | 300,000 | 6.0 |
| Brush 11 | 4 D | 240,000 | 8.5 |
| Brush 12 | 2.1 D | 300,000 | 1.5 |
| Brush 13 | 6 D | 86,000 | 3.5 |

One-component Non-magnetic Non-contact Developing Method; See FIG. 6

Figure 6:
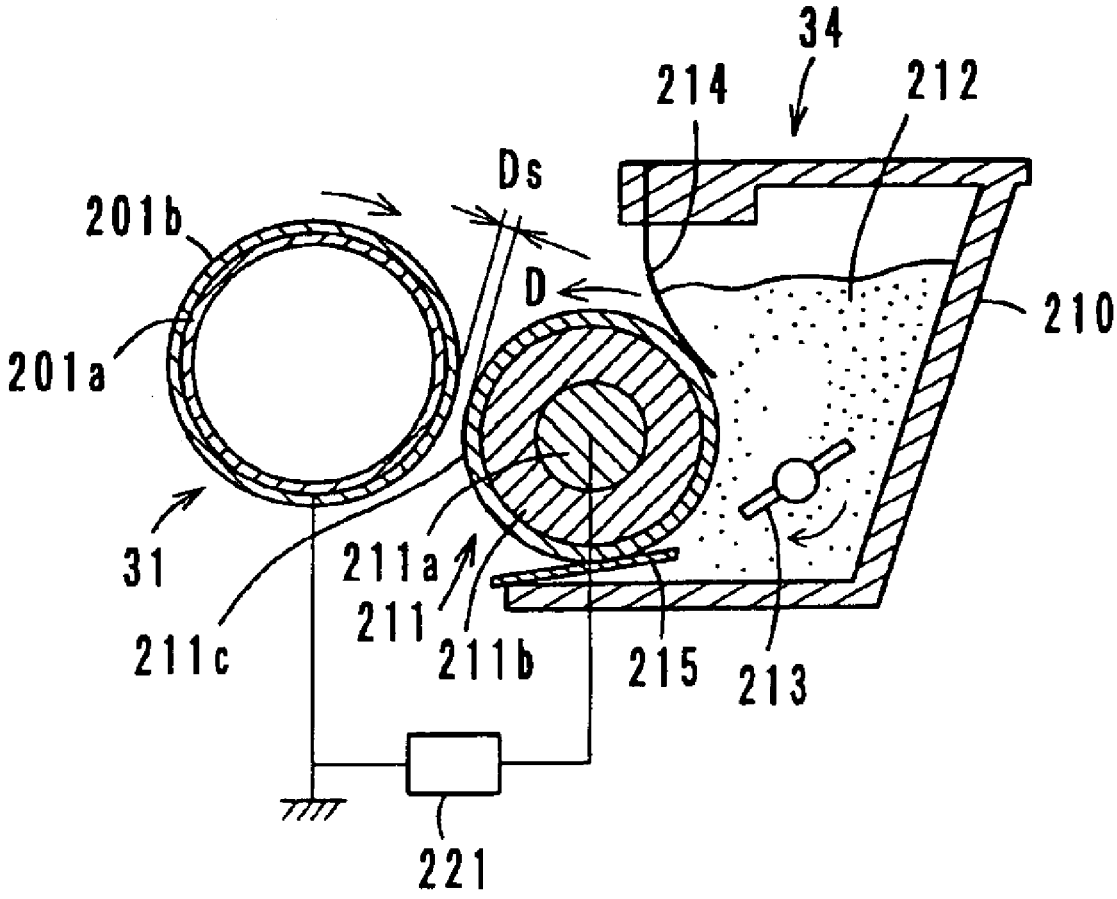
FIG. 6 is a cross sectional view of a developing device which is used to carry out a one-component non-magnetic non-contact developing method.

Next, a one-component non-magnetic non-contact developing method and a general structure of a developing device to carry out the method are described. FIG. 6 shows the positional relationship between each of the developing devices 34Y, 34M, 34C and 34K of the full-color developing unit 34 (which will be shown by each developing device 34) and the photosensitive drum 31 and the general structure of the developing device 34. The photosensitive drum 31 has a photosensitive layer 201*b* on the surface of a cylindrical conductive support 201*a*.

The developing device 34 has a developing roller 211 serving as a developer bearing member in a developer casing 210. The developing roller 211 can be rotated in a direction shown by arrow "D", and a toner regulator 214 and a sealant 215 are pressed against the developing roller 211. In the casing 210, a developer 212 are contained.

The developing roller 211 has a high-resistant layer 211*c* on a conductive elastic layer 211*b* around a conductive shaft 211*a*. The high-resistant layer 211*c* faces the photosensitive drum 31 at a specified developing gap Ds.

The developer 212 contained in the casing 210 is one-component non-magnetic toner, and the developer 212 is supplied to the circumferential surface of the developing roller 211 by rotation of a paddle wheel 213. As the developing roller 211 is rotating in the direction "D", the toner supplied to the circumferential surface of the roller 211 is spread out into a thin film by the regulator 214 and sent to a developing area while being charged by friction.

In synchronization with the sending of the toner to the developing area, a developing bias voltage which is a superimposed voltage of a DC voltage and an AC voltage is applied from a power source 221 to the developing roller 211. Thereby, in the developing area, a superimposed electric field of a DC electric field and an AC electric field occurs between the developing roller 211 and the photosensitive drum 31, and the toner on the circumferential surface of the developing roller 211 flows to an electrostatic latent image formed on the photosensitive drum 31. Consequently, the electrostatic latent image is developed.

The toner passing through the developing area is continuously sent in the direction "D" with rotation of the developing roller 211, and when the sealant 215 comes into contact with the circumferential surface of the developing roller 211, the toner consumption pattern at the developing area is erased. This contributes to formation of a thin toner layer with a uniform thickness.

One-component Non-magnetic Contact Developing Method; See FIG. 7

Figure 7:
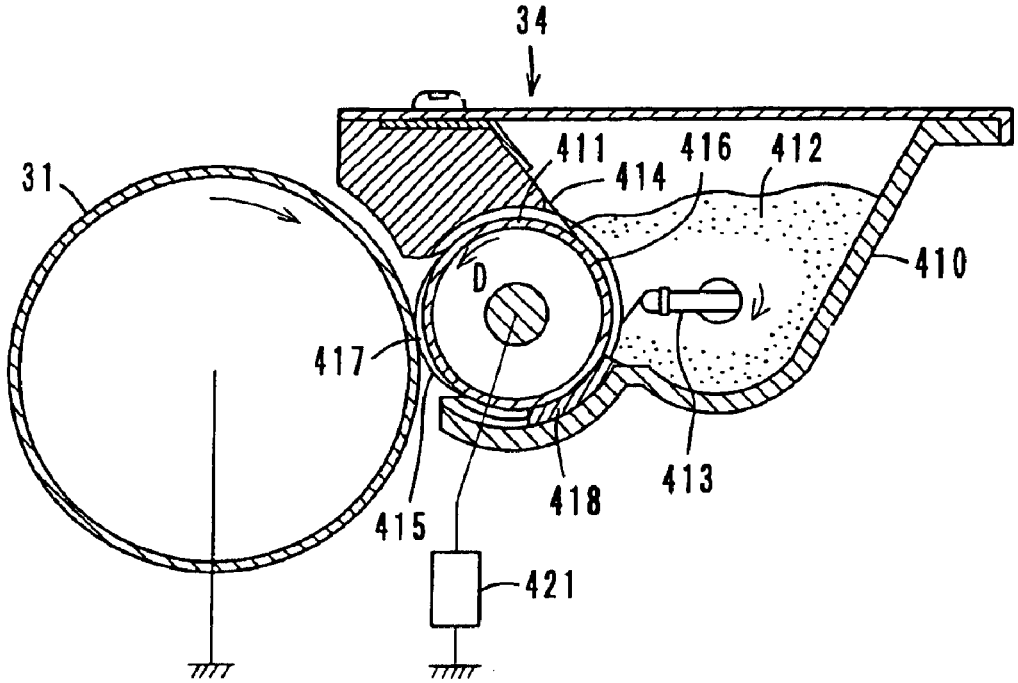
FIG. 7 is a cross sectional view of a developing device which is used to carry out a one-component non-magnetic contact developing method.

Next, a one-component non-magnetic contact developing method and a structure of a developing device to carry out the method are described. The developing devices 34 are of a type which is disclosed by Japanese Patent Laid-Open Publication No. 2001-228652 and which is shown by FIG. 7. Each of the developing devices 34 has a developing roller 411 in a developer casing 410, and the developing roller 411 is rotated in a direction shown by arrow "D". A thin film 415 is attached to the developing roller 411, and a toner regulator 414 is in contact with the developing roller 411. A developer 412 is contained in the casing 410.

The developer 412 in the casing 410 is one-component non-magnetic toner and is supplied to the circumferential surface of the developing roller 411 by rotation of a paddle wheel 413. The thin film 415 is rotated in the direction shown by arrow "D" by friction with the developing roller 411, and toner which comes in contact with the thin film 415 is forced to move in the direction shown by arrow "D" by the contact with the thin film 415 and by electrostatic force.

In the meantime, toner is fed into a wedge portion 416 between the thin film 415 and the tip of the regulator 414. Then, when the toner is pressed by the regulator 414, the toner is spread over the surface of the thin film 415 thinly and evenly and is electrified by friction. The toner bored on the thin film 415 comes to the developing area to face the photosensitive drum 31 as the thin film 415 is rotating accompanying the developing roller 411.

In synchronization with the feeding of the toner to the developing area, a DC developing bias voltage is applied to the developing roller 411 from a power source 421. In the developing area, due to the difference between the surface potential of the photosensitive drum 31 and the developing bias voltage, the toner which has been bored on the thin film 415 sticks to image portions on the photosensitive drum 31. In this way, development of an electrostatic latent image is carried out.

At the developing area, the thin film 415 comes into contact with the photosensitive drum 31 and comes out of contact with the developing roller 411 with a space 417 formed therebetween. The thin film 415 comes into contact with the photosensitive drum 31 softly and with an appropriate contact width, and it is possible to develop an electrostatic latent image evenly. Also, when there is a difference between the circumferential speed of the photosensitive drum 31 and the circumferential speed of the thin film 415, fogging in the background can be prevented, and destroy of a toner image once formed is prevented.

The toner passing through the developing area continues rotating in the direction shown by arrow "D" with the thin film 415, and when the thin film 415 is pressed by a pad 418, the toner consumption pattern at the developing area is erased. This contributes to formation of a thin toner layer with a uniform thickness.

Two-component Magnetic Non-contact Developing Method; See FIG. 8

Figure 8:
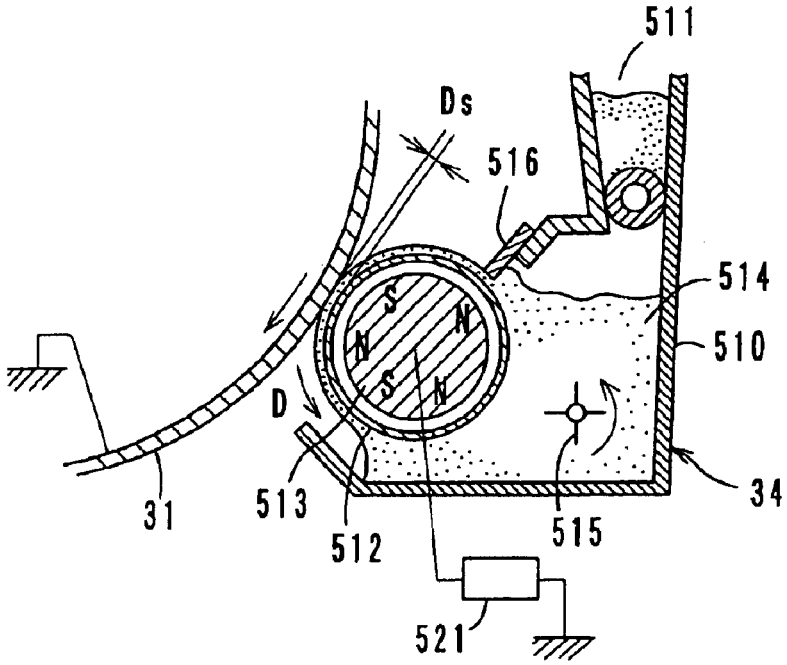
FIG. 8 is a cross sectional view of a developing device which is used to carry out a two-component magnetic non-contact developing method.

Next, a two-component magnetic non-contact developing method and a structure of a developing device to carry out the method are described. The developing devices 34 are of a type which is disclosed by Japanese Patent Laid-Open Publication No. 2001-22131 and which is shown by FIG. 8. Each of the developing devices 34 has a developing roller 514 in a developer casing 510, and a magnet roller 513 with magnetic poles N and S is fixedly provided in the developing roller 514. The developing roller 512 is rotated in a direction shown by arrow "D", and at a developing area, the developing roller 512 faces the photosensitive drum 31 at a specified gap Ds.

In the casing 510, a developer 514 is contained. The developer 514 is a mixture of carriers and toner, the carriers and toner being both magnetic. The toner is supplied from a hopper 511 to the casing 510 to make up for the toner consumption.

The developer 514 in the casing 510 comprises toner sticking to the circumferential surfaces of the carries electrostaticly, and the developer 514 is supplied to the circumsferential surface of the developing roller 512 by rotation of a paddle wheel 515. In this moment, the developer 514 is born like a brush on the circumferenctial surface of the developing roller 512 by the magnetic force of the magnet roller 513. Further, the length of the developer brush is regulated by a blade 516, and then, the developer 514 is fed to the developing area.

In synchronization with the feeding of the developer 514 to the developing area, a developing bias voltage which is an AC voltage or a superimposed voltage of an AC voltage and a DC voltage is applied to the developing roller 512 from a power source 521. Thereby, the toner is influenced by an oscillating electric field caused by the developing bias voltage and sticks to image portions on the photosensitive drum 31. In this way, development of an electrostatic latent image is carried out.

The developer 514 which passed through the developing area continues rotating in the direction shown by arrow "D" with the developing roller 512. Then, the developer 514 is stirred by the paddle wheel 515, and toner is newly supplied from the hopper 511.

Relationship Between Brush Charger and Developing Method

According to the present invention, a brush charger is improved. Specifically, a charging brush is made by planting thinner fibers at a higher density so that the charging brush can charge a photosensitive member evenly. Thereby, a color image of high quality can be obtained.

Conventionally, it has been impossible to carry out an AC-application non-contact developing method unless even charging of a photosensitive member is securely carried out, that is, unless a corona discharge method is adopted. However, the brush charger according to the present invention can be employed with a developing device which carries out the AC-application non-contact developing method.

In a non-contact developing method, there is a gap between a developer bearing member and a photosensitive member, and an electric field bends at a border between an electrostatic latent image portion and a non-image portion. Because of the bending of electric field, more toner sticks to the edge of an image portion. This results in an improvement in reproducibility of fine image portions and an improvement in visibility of fine lines of characters. On non-magnetic toner, an after-treatment agent (fluidizing agent) is spread to a small depth, and the toner does not apt to aging easily. Accordingly, the fluidity of the toner does not change easily, and even when a large number of printings is repeated, the quality of images can be maintained.

Conventionally, in order to carry out appropriate development by an AC-application non-contact developing method, it is necessary to use a charger which secures even charging of a photosensitive member.

In a non-contact developing method, generally, an AC bias voltage is applied to a developer bearing member in order to have toner flow toward a photosensitive member more effectively. If the amplitude of the AC bias voltage applied to the developer bearing member is too small, density unevenness will be caused, and it is necessary to apply a sufficiently high voltage as the developing bias voltage.

Figure 9:
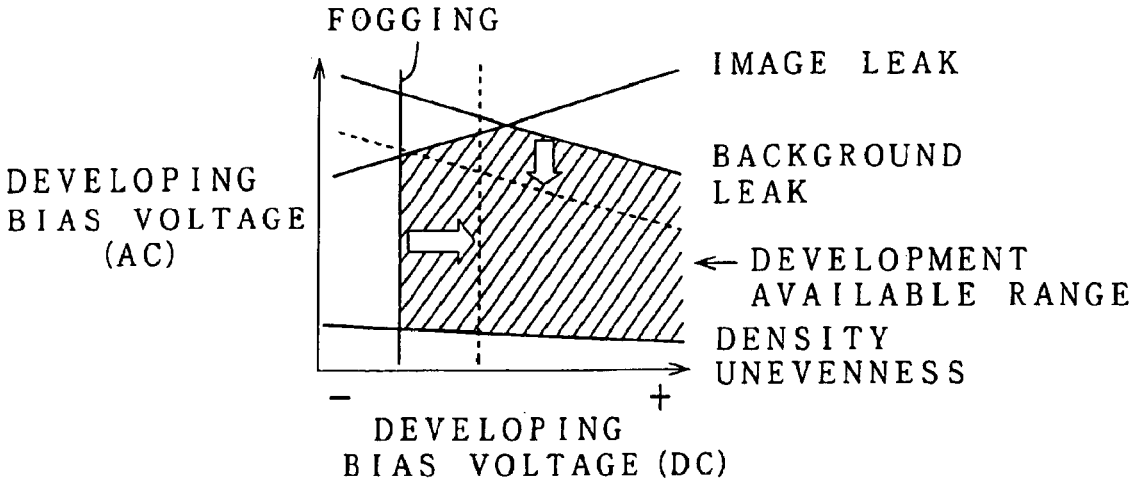
FIG. 9 is a graph which shows a development available region when the brush charger according to the present invention is used.
Figure 10:
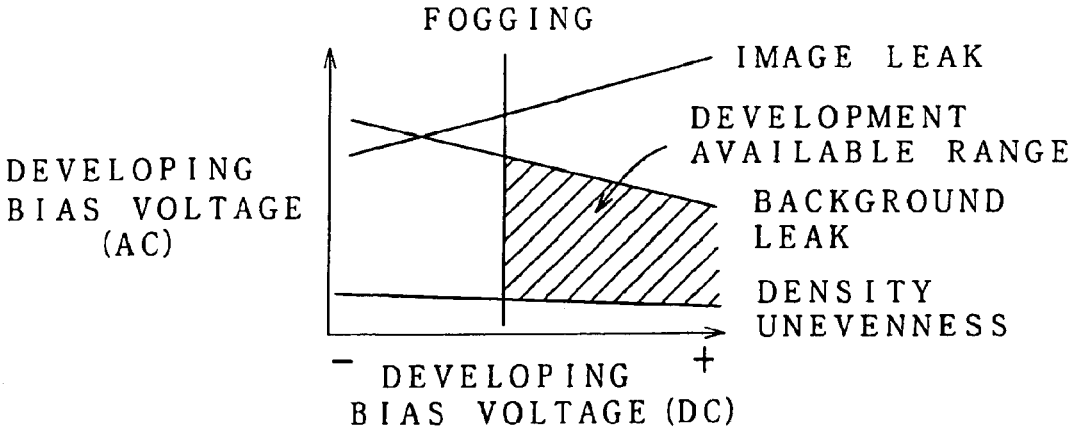
FIG. 10 is a graph which shows a development available region when a conventional brush charger is used.

As FIG. 9 shows, there are border lines of image leak, background leak and fogging around a development available region. If charging of the photosensitive member is uneven, the border lines of background leak and fogging move in the directions shown by the arrows in FIG. 9. Accordingly, the development available region is narrowed, and it becomes difficult to obtain desirable images. In FIG. 10, the hatched portion shows a development available region when a conventional brush charger is used.

In the graphs of FIGS. 9 and 10, the x-axis denotes a DC developing bias voltage, and the y-axis denotes an AC developing bias voltage. FIGS. 9 and 10 show development available regions when a non-contact developing method is carried out.

The term "image leak" means a phenomenon that white spots are seen in image portions. This phenomenon is caused by movement of electric charge from the developer bearing member to the image portions (electrostatic latent image) on the photosensitive member because of too large a difference between the surface potential Vi of the photosensitive member and the developing bias voltage Vmin. The term "background leak" means a phenomenon that black spots are seen in the background. This phenomenon is caused by erasure of the surface potential of the photosensitive member because of too large a difference between the developing bias voltage Vmax and the surface potential of non-image portions (the initial surface potential Vo) of the photosensitive member. Also, fogging means a phenomenon that the background becomes dark because the surface potential of the photosensitive member is too low.

Figure 11:
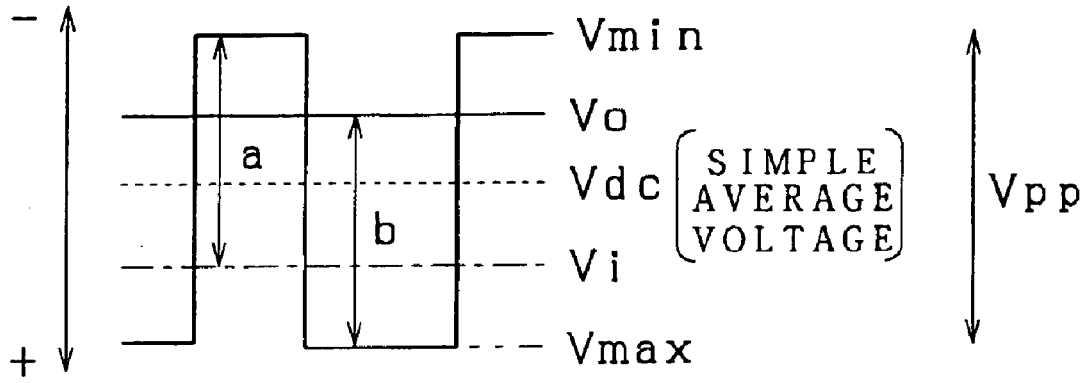
FIG. 11 is a chart which shows electric fields which act in a development available region.

For the reasons above, in order to enable a brush charger to be employed with a developing device which carries out AC-application non-contact development, the brush charger must have an improved performance to charge a photosensitive member more evenly. In AC-application non-contact development, because an AC developing bias voltage Vpp (see FIG. 11) is applied, lots of after-treatment agent comes off from toner, and lots of refuse remains on a photosensitive member. Thereby, in charging the photosensitive member by a contact method, the charger is apt to get dirty. Therefore, when a large number of printings is repeated, it is impossible to repeat even charging of the photosensitive member.

The brush charger according to the present invention can charge a photosensitive member more evenly and therefore can be used with a developing device which carries out AC-application non-contact development. When the brush charger is used, refuse such as an after-treatment agent which came off from toner is taken into the brush, and even when a large number of printings is repeated, the charging performance of the brush charger hardly changes. Also, if refuse sticks to the fibers of the brush more or less, by increasing the circumferential speed of the brush in relation to the circumferential speed of the photosensitive member, uneven charging can be inhibited. Thus, even charging of the photosensitive member is possible at all times, and therefore, it is possible to form images of high quality repeatedly.

Experimental Image Forming Methods

The present inventors conducted experiments 1 through 21 by carrying out the following image forming methods, and the evenness of charging of the photosensitive drum and the picture quality were evaluated. The experiments 1 through 21 were combinations of the brushes 1 through 13 shown by Table 1 and the following developing methods A through D.

Method A: One-component Non-magnetic Non-contact Developing Method

A full-color laser printer as shown by FIG. 1 provided with four developing devices shown by FIG. 6 was used to form images.

The image formation was performed under the following conditions:

- a voltage of —1,100V was applied to the charging brush to charge the photosensitive drum;
- the charging brush was rotated in the counter direction at a circumferential speed which was one to three times the circumferential speed of the photosensitive drum or in the with direction at a circumferential speed which was two times the circumferential speed of the photosensitive drum;
- the fibers of the charging brush came into the photosensitive drum to a depth of 0.5 mm;
- a DC voltage of −350V and an AC voltage of 1.5 kV were applied as the developing bias voltage;
- the gap between the photosensitive drum and the developing roller at the developing area (developing gap) was 0.13 mm; and
- the photosensitive drum was rotated at a circumferential speed of 160 mm/sec.

Method B: One-component Non-magnetic Contact Developing Method

A full-color laser printer as shown by FIG. 1 provided with four developing devices shown by FIG. 7 was used to form images.

The image formation was performed under the following conditions:

- a voltage of −1,100V was applied to the charging brush to charge the photosensitive drum;
- the charging brush was rotated in the counter direction at a circumferential speed which was two times the circumferential speed of the photosensitive drum;
- the fibers of the charging brush came into the photosensitive drum to a depth of 0.5 mm;
- a DC voltage of −280V was applied as the developing bias voltage; and
- the photosensitive drum was rotated at a circumferential speed of 100 mm/sec.

Method C: Two-component Magnetic Non-contact Developing Method

A full-color laser printer as shown by FIG. 1 provided with four developing devices shown by FIG. 8 was used to form images. The image formation was performed under the following conditions:

- a voltage of −1,100V was applied to the charging brush to charge the photosensitive drum;
- the charging brush was rotated in the counter direction at a circumferential speed which was two times the circumferential speed of the photosensitive drum;
- the fibers of the charging brush came into the photosensitive drum to a depth of 0.5 mm;
- a DC voltage of −350V and an AC voltage of 1.5 kV were applied as the developing bias voltage, the AC having a frequency of 3 kHz, a duty factor of 1:1 and a rectangular waveform;
- the developing gap was 0.4 mm; and
- the photosensitive drum was rotated at a circumferential speed of 300 mm/sec.

Method D: One-component Non-magnetic Non-contact Developing Method

- an DC voltage of −600V and an AC voltage of 1.2 kV were applied to the charging brush to charge the photosensitive drum, the AC having a frequency of 1.5 kHz, a duty factor of 1:1 and a rectangular waveform;
- the charging brush was rotated in the counter direction at a circumferential speed which was two times the circumferential speed of the photosensitive drum;
- the fibers of the charging brush came into the photosensitive drum to a depth of 0.5 mm;
- a DC voltage of −350V and an AC voltage of 1.5 kV were applied as the developing bias voltage;
- the developing gap was 0.13 mm; and
- the photosensitive drum was rotated at a circumferential speed of 160 mm/sec.

Evaluation of the Results of Experiments

Combining the brushes 1 through 13 shown in Table 1 and the image forming methods A through C, experiments 1 through 19 were conducted under the circumstances of 25° C. and 50% RH. Table 2 shows evaluation of the results of the experiments.

TABLE 2

| | Conditions | | | Evaluation | |
|---|---|---|---|---|---|
| ExperiMent No. | Brush No. | Image Forming Method | Rotating Direction/ Circumferential Speed of Brush* | Evenness of Charging | White Strips In Halftone |
| 1 | 1 | A | Counter/2 | ◎ | ◎ |
| 2 | 1 | B | Counter/2 | ◎ | ◎ |
| 3 | 1 | C | Counter/2 | ◎ | ◎ |
| 4 | 2 | A | Counter/2 | ◎ | ◎ |
| 5 | 3 | A | Counter/2 | ◎ | ◎ |
| 6 | 4 | A | Counter/2 | ◎ | ◎ |
| 7 | 5 | A | Counter/2 | ◎ | ◎ |

TABLE 2-continued

| | Conditions | | | Evaluation | |
|---|---|---|---|---|---|
| ExperiMent No. | Brush No. | Image Forming Method | Rotating Direction/ Circumferential Speed of Brush* | Evenness of Charging | White Strips In Halftone |
| 8 | 6 | A | Counter/2 | ◎ | ◎ |
| 9 | 7 | A | Counter/2 | ○ | ○ |
| 10 | 1 | A | Counter/3 | ◎ | ◎ |
| 11 | 1 | A | Counter/1.5 | ◎ | ◎ |
| 12 | 1 | A | Counter/1 | ○ | ◎ |
| 13 | 1 | A | With/2 | ○ | ◎ |
| 14 | 8 | A | Counter/2 | ○ | X |
| 15 | 9 | A | Counter/2 | X | ◎ |
| 16 | 10 | A | Counter/2 | X | ◎ |
| 17 | 11 | A | Counter/2 | X | ○ |
| 18 | 12 | A | Counter/2 | X | ◎ |
| 19 | 13 | A | Counter/2 | X | X |

*The values are when the circumferential speed of the photosensitive drum is regarded to be 1.

After printing 1,000 sheets of a monochromatic image with 5% black portions on a white background, a high-definition color digital standard image SCID was printed. The evenness of charging was evaluated by viewing the image SCID. The marks ◎, ○ and X in Table 2 denote the following states, respectively.

◎: excellent in picture quality

○: fair in picture quality, not causing practical problems

X: poor in picture quality, causing practical problems

Also, after printing 1,000 sheets of a monochromatic image with 5% black portions on a white background, a halftone image with 2×2 dots was printed. Then, the halftone image was checked whether white strips can be seen. The marks ◎, ○ and X in Table 2 denote the following states, respectively.

◎: no white strips

○: few white strips, not causing practical problems

X: white strips, causing practical problems

Combining the brush 1 shown in Table 1 with the image forming methods A and D, experiments 20 and 21 were conducted under the circumstances of 25° C. and 50% RH. Table 3 shows evaluation of the results of the experiments. image was evaluated. The marks ○ and X in Table 3 denote the following states, respectively.

○: fair in picture quality, not causing practical problems

X: poor in picture quality, causing practical problems

OTHER EMBODIMENTS

The present invention has been described in connection with the preferred embodiments above, it is to be noted that various changes and modifications are possible to those who are skilled in the art. Such changes and modifications are to be understood as being within the present invention.

What is claimed is:

1. A brush charger comprising:

a charging brush roller for charging an object, the roller having a brush with a large number of conductive fibers; and a conductive support which supports the charging brush roller; wherein:

the conductive fibers have a thickness D within a range from 1.5 deniers to 4 deniers, have a length L not less than 2 mm and are planted at a density not less than 150,000 filaments/inch$^2$; and the thickness D and the length L of the conductive fibers meet the following condition:

$$D \geqq 0.71L - 1.61.$$

2. A brush charger according to claim 1, wherein the conductive fibers are made of a material mainly containing nylon.

3. A brush charger according to claim 1, wherein the conductive fibers have a thickness D within a range from 1.5 deniers to 2.5 deniers.

4. A brush charger according to claim 1, wherein the conductive fibers are planted at a density not less than 250,000 filaments/inch$^2$.

5. A brush charger according to claim 1, wherein tips of the conductive fibers are curled using a curling treatment.

6. A brush charger according to claim 5, wherein the curling treatment is a treatment using heat.

7. A brush charger according to claim 5, wherein the curling treatment is a treatment using electricity.

8. A brush charger according to claim 1, wherein the charging brush roller is rotated in a direction opposite to a moving direction of the object.

TABLE 3

| | Conditions | | | Evaluation (No. of Times of Printing) | | | |
|---|---|---|---|---|---|---|---|
| ExperiMent No. | Brush No. | Image Forming Method | Rotating Direction/ CircumFerential Speed of Brush* | Initial State | 5,000 | 10,000 | 15,000 |
| 20 | 1 | A | Counter/2 | ○ | ○ | ○ | ○ |
| 21 | 1 | D | Counter/2 | ○ | ○ | X | |

*The values are when the circumferential speed of the photosensitive drum is regarded to be 1.

After printing the respective numbers of sheets of a monochromatic image with 5% black portions on a white background continuously, a high-definition color digital standard image SCID was printed, and the quality of the

9. A brush charger according to claim 8, wherein at an area where the charging brush roller is in contact with the object, the charging brush roller moves at a speed which is one or more times a moving speed of the object.

10. A brush charger according to claim 1, wherein a DC voltage is applied to the charging brush roller.

11. A brush charger according to claim 1, wherein the charging brush roller is made by winding a band-like conductive brush on a circumferential surface of the conductive support spirally.

12. An image forming apparatus comprising:

an electrostatic latent image bearing member;

a brush charger according to claim 1;

an electrostatic latent image forming device for forming an electrostatic latent image on the image bearing member after charging of the image bearing member by the brush charger; and a developing device for developing the electrostatic latent image.

13. An image forming apparatus according to claim 12, wherein:

the charging brush roller is rotated in a direction opposite to a moving direction of the image bearing member; and at an area where the image bearing member and the charging brush member are in contact with each other, the charging brush roller moves at a speed which is 1.5 to 3 times a moving speed of the image bearing member.

14. An image forming apparatus according to claim 12, further comprising a DC source for applying a DC voltage to the charging brush roller.

15. An image forming apparatus according to claim 14, wherein the DC source applies a DC voltage within a range from −1,600V to −800V to the charging brush roller.

16. An image forming apparatus, comprising:

an electrostatic latent image bearing member;

a brush charger comprising:

a charging brush roller for charging an object, the roller having a brush with a large number of conductive fibers; and a conductive support which supports the charging brush roller; wherein:

the conductive fibers have a thickness D within a range from 1.5 deniers to 4 deniers, have a length L not less than 2 mm and are planted at a density not less than 150.000 filaments/inch$^2$, and the thickness D and the length L of the conductive fibers meet the following condition: $D \geqq 0.71L-1.61$;

an electrostatic latent image forming device for forming an electrostatic latent image on the image bearing member after charging of the image bearing member by the brush charger; and a developing device for developing the electrostatic latent image;

wherein the conductive fibers of the charging brush comes into the image bearing member to a depth within a range from 0.2 mm to 0.8 mm.

17. An image forming apparatus comprising:

an electrostatic latent image bearing member;

a brush charger for charging the image bearing member, the brush charger having a brush with a large number of conductive fibers and being supplied with a DC voltage, the conductive fibers having a thickness within 1.5 deniers to 4 deniers and being planted at a density not less than 150,000 filaments/inch$^2$;

an electrostatic latent image forming device for forming an electrostatic latent image on the image bearing member after charging of the image bearing member by the brush charger; and a developing device for developing the electrostatic latent image by a non-contact developing method, the developing device having a developer bearing member;

wherein, when a developing bias voltage which is a superimposed voltage of a DC voltage and an AC voltage is applied to the developer bearing member, toner flows from the developer bearing member to the image bearing member to develop the electrostatic latent image.

18. An image forming apparatus according to claim 17, wherein: the conductive fibers have a length L not less than 2 mm; and the thickness D and the length L of the conductive fibers meet the condition, $D \geqq 0.71L-1.61$.

19. An image forming apparatus according to claim 17, wherein the brush charger is a roller.

20. An image forming apparatus according to claim 19, wherein: the charging brush roller is rotated in a direction opposite to a moving direction of the image bearing member; and at an area where the image bearing member and the charging brush roller are in contact with each other, the charging brush roller moves at a speed which is 1.5 to 3 times a moving speed of the image bearing member.

21. An image forming apparatus according to claim 17, wherein a developer contained in the developing device is non-magnetic one-component toner.

22. An image forming apparatus according to claim 17, further comprising a DC source for applying a DC voltage to the brush charger.

* * * * *